United States Patent [19]

Waite

[11] 4,200,114

[45] Apr. 29, 1980

[54] SMOKING APPLIANCE

[76] Inventor: Howard W. Waite, P.O. Box 144, Inverness, Calif. 94937

[21] Appl. No.: 876,923

[22] Filed: Feb. 10, 1978

[51] Int. Cl.[2] ..... A24F 13/00

[52] U.S. Cl. ..... 131/178; 131/171 R

[58] Field of Search ..... 131/178, 174, 171, 185, 131/202, 298, 175, 215 A, 215 B; 128/139, 146.6, 203

[56] References Cited

U.S. PATENT DOCUMENTS

| | | | |
|---|---|---|---|
| 403,966 | 5/1889 | Smith | 128/146.4 |
| 2,626,613 | 1/1953 | Glance | 131/174 |
| 3,315,672 | 4/1967 | Cunningham et al. | 128/139 |
| 3,476,119 | 11/1969 | Walton | 131/171 |
| 3,889,690 | 6/1975 | Guarnieri | 131/185 |
| 4,083,374 | 4/1978 | Jacobsen | 131/178 |

FOREIGN PATENT DOCUMENTS

| | | | |
|---|---|---|---|
| 843586 | 8/1960 | United Kingdom | 128/203 |

*Primary Examiner*—Stephen C. Pellegrino
*Attorney, Agent, or Firm*—Limbach, Limbach & Sutton

[57] ABSTRACT

A device for enclosing a cigarette when being smoked, wherein a series of check valves are provided in conjunction with a smoke filter for permitting a smoker to draw smoke into the lungs and discharge it without affecting significantly a surrounding atmosphere.

6 Claims, 4 Drawing Figures

SMOKING APPLIANCE

BACKGROUND OF THE INVENTION

For years studies have shown the harmful effects of smoke from tobacco and the like on the person doing the smoking, and many means have been developed to reduce these harmful effects. Recent studies now show that a non-smoker, obliged to breathe in the vicinity of a smoker, is subject to the same or greater harmful effects.

SUMMARY AND OBJECT OF THE INVENTION

This invention relates to an appliance composed of a face piece fitted to the smoker, a combustion chamber containing burning tobacco or the like, and an intermediate section with a series of check valves and passageways. Air for normal breathing is drawn in through one check valve into the face piece, and exhaled through a second check valve into the combustion chamber. Both exhaled air and smoke are then forced through a third check valve and a filter before exiting to the atmosphere. A mixture of smoke and air may also be drawn through a fourth check valve into a mouthpiece in the face piece. The mixture is then blown back into the combustion chamber either through the aforementioned second check valve or through a fifth check valve, and then exited to the atmosphere through the third check valve and filter. A contoured edge of the face piece together with a soft rim provide an airtight seal between the internal passageways and chambers of the appliance and the surrounding atmosphere.

The object of this invention is to provide an appliance to confine the smoke from burning tobacco or the like, to provide for circulation of air for breathing and for combustion, and to filter both products of combustion and the exhalation from the user of the appliance so as to remove smoke and odor before release to the surrounding atmosphere.

DESCRIPTION OF THE PREFERRED EMBODIMENT

Figure 2:
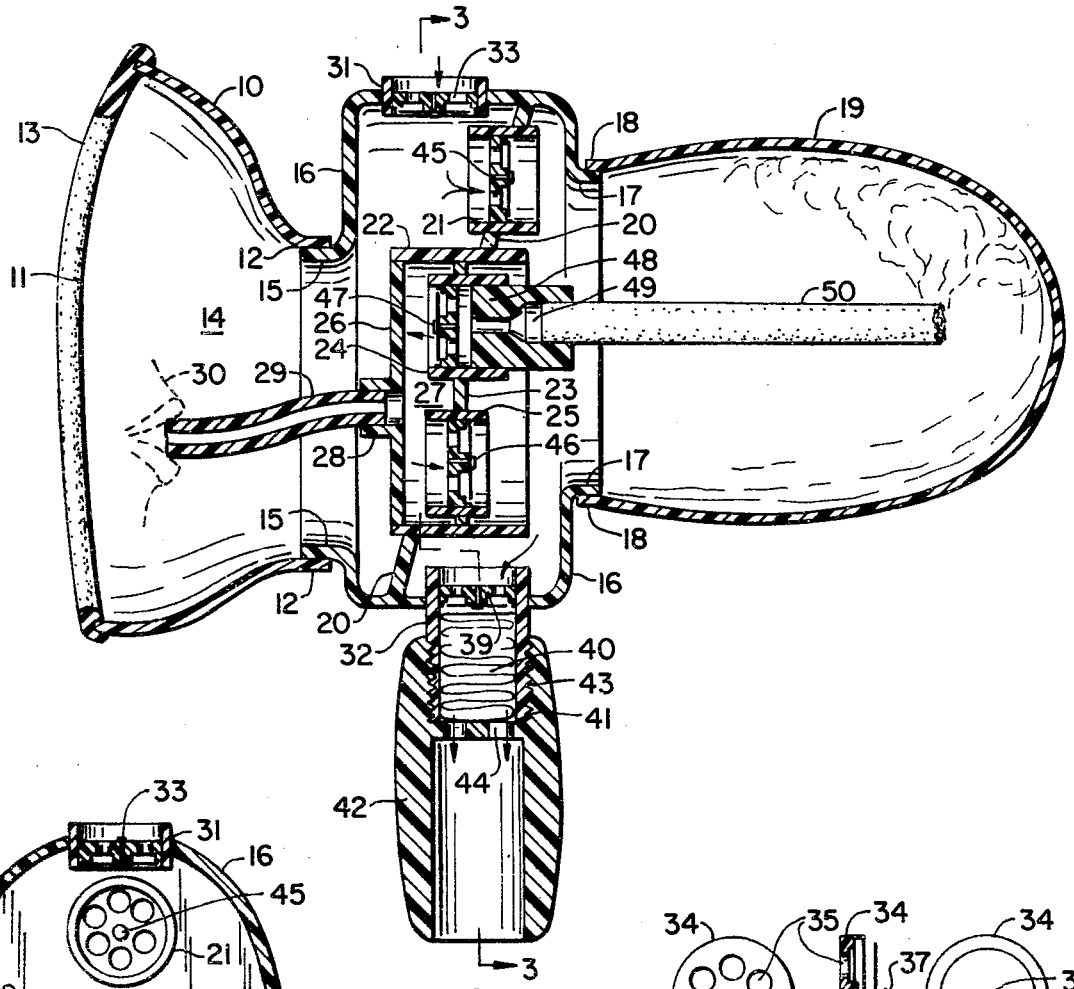
FIG. 2 is a longitudinal section of the appliance of FIG. 1.
Figure 3:
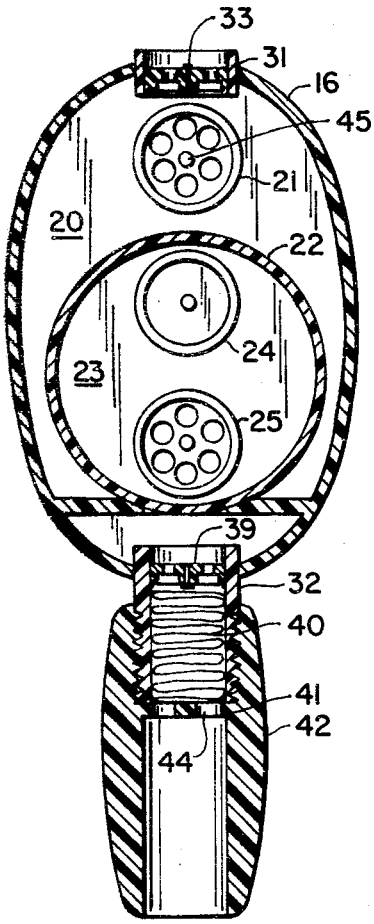
FIG. 3 is a lateral section of FIG. 2 taken along line 3—3.
Figure 4:
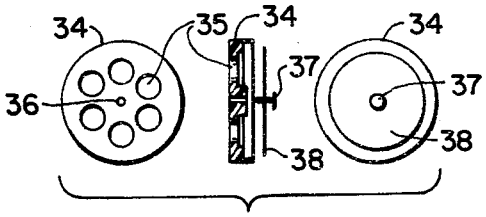
FIG. 4 is a detail of one type of check valve assembly of the appliance of FIGS. 2-3.
Figure 1:
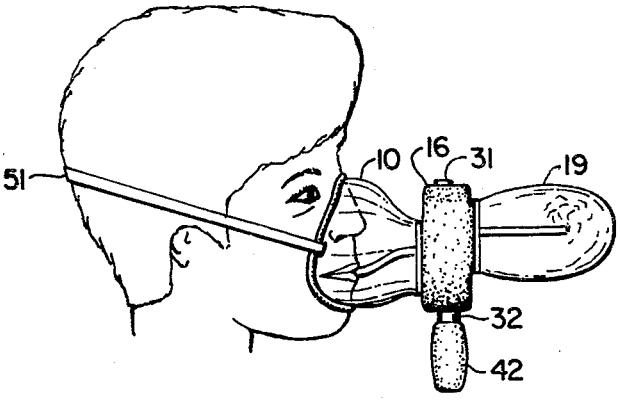
FIG. 1 is a side view of the complete appliance, as worn by a user, showing the appliance held in place by means of a head strap.

A face piece 10 of molded plastic, has one contoured side 11 and an opposite side with a circular opening 12. The contoured edge is formed to match the facial shape from above the nose to below the mouth of the average adult. Because the opening 12 is standardized, individualized face pieces can be provided when necessary. All face pieces have a soft rubber rim 13 for the comfort of the user, and to ensure an airtight seal between the space inside the face piece 14 and the surrounding atmosphere.

The opening 12 of the face piece fits snugly over a matching circular opening 15 of an intermediate section 16, which is also molded of plastic and has an opposite circular opening 17 over which snugly fits a matching circular opening 18 of a plastic molded combustion chamber 19. A partition 20 diagonally divides the two ends of the intermediate sections and provides support for two penetrating cylindrical sleeves 21 and 22. The larger sleeve 22 also has a partition 23 which in turn supports two additional cylindrical sleeves 24 and 25. The face piece end of the sleeve 22 is fitted with a circular cover 26, thus creating a small plenum 27. An opening 28 in this cover snugly fits over a mouthpiece 29 shaped to connect the plenum 27 with the mouth 30 of the smoker.

Through the top wall of the intermediate section 16 on the face piece side of the partition 20 is molded a short cylindrical sleeve 31, and through the bottom wall on the combustion chamber side of the partition 20 is another, longer sleeve 32. Pressed into the sleeve 31 is an inwardly directed check valve 33 composed of a plastic disc 34 having a series of holes 35 for passage of air and a central hole 36 to receive a fastening plastic pin 37. The pin holds a flat disc of rubber 38 against one face of the disc 34. Pressed into the longer sleeve 32 is another similar check valve assembly 39 directed outwardly. Also in the sleeve 32 below the check valve 39 is a removable cartridge 40 of activated charcoal or similar smoke and odor-absorbing material. This package is held in place by a partition 41 in the center of a hollow handle 42 which is fastened to the longer sleeve 32 by means of matching threads 43. The partition 41 contains a series of holes 44 for the passage of air leaving the cartridge 40.

Fitted into the smaller sleeve 21 in the partition 20 is another check valve assembly 45 directed toward the combustion chamber 19. Similarly, a check valve assembly 46 in the sleeve 25 is placed so as to direct flow toward the combustion chamber 19, and a check valve assembly 47 is placed in the sleeve 24 to direct flow from the chamber 19 to the plenum 27. The sleeve 24 is also fitted with a bushing 48 with a center hole 49, sized to accommodate a cigarette 50, or similar article for the burning of tobacco or the like.

In addition to being held by the handle 42, the appliance can be fastened to the user by means of a headband 51.

To use the appliance, a cartridge of smoke and odor-absorbing material 40 is placed into the lower part of the sleeve 32 and held in place by threading on the handle 42. The face piece 10 conforming to the facial features of the user is pressed onto the intermediate section 16, and a cigarette or similar item of tobacco or the like inserted into the properly sized bushing 48. The tobacco is ignited in the usual way and the cover 19 of the combustion chamber is immediately fastened to the intermediate section by pressing the circular opening 18 over the matching opening 17. By holding the face piece of the appliance tightly against his or her face, the user is then able to inhale smoke from the cigarette 50, through the bushing 48 and check valve assembly 47 into plenum 27 and thence through mouthpiece 29. This inhaling action withdraws some air from the combustion chamber 19 which is replaced by air flowing through the check valve assemblies 45 and 33. Upon exhaling, if by mouth, the combined smoke and air from the user is blown back through the mouthpiece 29 to the plenum 27, then through the check valve assembly 46 into the combustion chamber 19, where, together with a portion of the smoke from the burning tobacco which has been collecting in the combustion chamber, the total exhalation is blown pass the check valve assembly 39, through the filter and odor-absorbing cartridge 40 and out through the holes 44 to the surrounding atmosphere.

Should the user choose to exhale by nose, the air and smoke mixture passes from the space 14, through the check valve assembly 45, to the combustion chamber 19 and then onto the check valve assembly 39 as before.

If normal breathing without smoke is desired while the appliance is in place, such as being worn by the headband, the user inhales through the nose, or by mouth without sucking on the mouthpiece, and thus draws in fresh air through the check valve assembly 33 into the space 14 and thence into the lungs. Upon exhaling, the exhaled air is forced through the check valve assembly 45 into the combustion chamber 19, thus introducing relatively fresh air to help maintain the combustion of the tobacco even though the user of the appliance is not drawing in air and smoke through the mouthpiece 29. This same introduction of relatively fresh air into the combustion chamber forces an equal volume of smoke-laden air to flow out through the check valve assembly 39 and into the atmosphere through the filtering system as described above.

I claim:

1. A smoking device comprising a face piece formed and qasketed in a manner to make an airtight seal between the atmosphere and the nose and mouth of the user, the face piece fitted by means of standardized circular matching openings to an intermediate section, a partition in the intermediate section, the intermediate section containing an inwardly directed first check valve on the face piece side of the intermediate section for the entrance of air inhaled through the nose of the user, said partition containing a second check valve directing air exhaled from the user into a combustion chamber fitted by matching circular openings to the intermediate section on a side thereof opposite from said face piece, said combustion chamber adapted to contain burning tobacco or the like, an outwardly directed third check valve in the combustion chamber side of said partition, a cartridge of smoke and odor absorbing material positioned at the discharge side of the outwardly directed third check valve to filter all exhaled air, smoke, and other gases from combustion of tobacco or the like before entering the surrounding atmosphere, wherein said combustion chamber includes means for holding burning tobacco or the like in a closed chamber so as to prevent any of the products of combustion from entering the surrounding atmosphere, and said smoking device additionally comprises a fourth check valve in the partition of the intermediate section, said fourth check valve connected to said holder of the burning material and directing smoke and gases from the combustion chamber to a small plenum, a mouth piece within said face piece and connected to the small plenum, whereby the plenum may be connected to the mouth of the user, a fifth check valve in said partition communicating between the mouth piece and the combustion chamber for carrying gases through the partition from the mouth piece whereby the user may exhale through the mouth piece into the combustion chamber and out said third check valve.

2. A smoking device comprised of a face piece, an intermediate section, and a combustion chamber, said face piece having one edge formed and gasketed to provide a seal between the atmosphere and the nose and mouth of the user, the other edge of the face piece fastened to the intermediate section by matching circular openings, the intermediate section is in turn similarly fastened to the combustion chamber holding burning tobacco or the like, said intermediate section having an inwardly directed check valve allowing ambient air to flow in and an outwardly directed check valve through which products of combustion are discharged to the atmosphere, said smoking device having a partition within an intermediate section, said partition separating one side of the intermediate section from the face piece and the other side from the combustion chamber, the partition penetrated by a small sleeve containing a check valve which allows air and exhalation from the nose of the user to pass into the combustion chamber, the partition also penetrated by a larger sleeve having a cover and an interior partition which together form a small plenum, the interior partition also penetrated by two small sleeves each containing a check valve, the inlet side of one check valve in conduit with a holder for burning tobacco or the like thus allowing the products of combustion to pass into the small plenum, the other interior partition check valve directed to allow air and other gases in the small plenum to pass into the combustion chamber, the cover of the small plenum fitted with an opening and a mouth piece extending through the face piece, thereby providing easy access to the mouth of the user.

3. A smoking device according to claim 2 which additionally comprises removable smoke and odor absorbing material positioned in the path of said outwardly directed check valve, whereby exhaled breath of the user and smoke and gases from the combustion chamber are filtered before being exhausted to the atmosphere.

4. A smoking device of claim 2 wherein the various check valves are all of the same size and construction and all are readily removable for cleaning or for replacement.

5. A smoking device, comprising:

an enclosed chamber formed of a wall, said chamber opening at one location through a face mask and containing means for holding therein a burning material such as a cigarette or other tobacco product, said face mask being shaped and gasketed in a manner to provide a substantially air tight seal between the interior of said chamber and a facial portion of a user of the device including the user's nose and mouth, intake means in said chamber wall for letting air into the chamber upon suction being applied to said face mask by the user, discharge means in said chamber wall for letting air and smoke out of the chamber upon an increased air pressure being applied to said face mask by the user blowing thereinto, and means associated with said discharge means for filtering smoke and gases of combustion from air being discharged from the chamber before entering the atmosphere surrounding the device, whereby said smoke and gases are trapped and prevented from polluting the atmosphere surrounding a smoker.

6. A hand held smoking device, comprising:

an enclosed chamber formed of a wall, said chamber opening at one end through a face mask that is shaped and gasketed in a manner to provide a substantially air tight seal between the interior of said chamber and a facial portion of a user of the device including the user's nose and mouth, a partition extending across said chamber at a location intermediate of said one end and another end, a volume formed between said partition and said another end serving as a combustion portion of said chamber, means attached to said partition for holding within said combustion chamber portion burning material such as a cigarette or other tobacco product, a first check valve positioned in said chamber wall on the face mask side of said partition and adapted to permit air to flow thereinto when suction is applied by the user but preventing air from flowing out of said chamber, a second check valve positioned in said chamber wall on the side of said partition of said combustion chamber portion and adapted to permit air to flow out of said chamber, but not into said chamber, means associated with said second check valve for filtering air discharged from said chamber through the second check valve before entering the atmosphere surrounding the device, thereby significantly reducing pollution of the atmosphere surrounding the device from said burning material, a third check valve positioned in said partition and adapted to permit air to flow into the combustion portion of the chamber from the face mask but not in an opposite direction, whereby the user's breath and expelled smoke is passed through said third check valve into the combustion portion of the chamber and thence out through said second check valve, a fourth check valve positioned on said partition in communication with said burning material holding means and adapted to permit smoke from burning material to be drawn through said partition, a fifth check valve positioned on said partition adjacent said fourth check valve and adapted to permit air to pass only from the mask side of the partition into the combustion chamber, whereby air passing through the third and fifth check valves provides oxygen to support burning within said combustion portion of the chamber, a plenum formed on said partition on the side of the face mask and covering said fourth and fifth check valves, and a mouth piece extending from said plenum within said face mask, whereby the user can draw smoke from the burning material through the mouth piece and said fourth check valve, and then discharge said smoke through the mouth piece, said fifth check valve and said second check valve without filling the volume of the face mask with smoke, thereby permitting the user to breathe through the nose fresh air that is provided through said first check valve.

* * * * *